US005456581A

United States Patent [19]

Jokela et al.

[11] Patent Number: 5,456,581

[45] Date of Patent: Oct. 10, 1995

[54] CONTROL SYSTEM FOR A MULTI-PISTON PUMP WITH SOLENOID VALVES FOR THE PRODUCTION OF CONSTANT OUTLET PRESSURE FLOW

[75] Inventors: Gregory R. Jokela, Oakview; Roman Kruchowy, Somis; James Massey, Ventura, all of Calif.

[73] Assignee: The United States of America as represented by the Secretary of the Navy, Washington, D.C.

[21] Appl. No.: 290,669

[22] Filed: Aug. 12, 1994

[51] Int. Cl.[6] ..... F04B 49/00; F04B 19/00; F04B 27/08; F04B 1/26

[52] U.S. Cl. ..... 417/282; 417/270; 417/307; 417/315

[58] Field of Search ..... 417/282, 270, 417/295, 298, 307, 315

[56] References Cited

U.S. PATENT DOCUMENTS

| | | | |
|---|---|---|---|
| 2,661,695 | 12/1953 | Ferris | 417/315 |
| 2,800,857 | 7/1957 | Yarmak | 417/315 |
| 2,935,952 | 5/1960 | Rose | 417/315 |
| 3,556,679 | 1/1971 | Middlebusher et al. | 417/315 |
| 3,679,328 | 7/1972 | Cattanach | 417/270 |
| 4,579,145 | 4/1986 | Leiber et al. | 251/129.16 |
| 4,600,364 | 7/1986 | Nakatani et al. | 417/222.2 |
| 4,934,143 | 6/1990 | Ezell et al. | 417/222.1 |
| 4,946,350 | 8/1990 | Suzuki et al. | 417/270 |
| 4,958,989 | 9/1990 | Frantz | 417/222.1 |
| 5,088,520 | 2/1992 | Haynes et al. | 251/129.16 |
| 5,110,087 | 5/1992 | Studtmann et al. | 251/129.16 |
| 5,135,070 | 8/1992 | Schwiyalla . | |
| 5,259,738 | 11/1993 | Salter et al. | 417/270 |
| 5,295,795 | 3/1994 | Yasuda et al. | 417/270 |

FOREIGN PATENT DOCUMENTS

| | | | |
|---|---|---|---|
| 1564387 | 5/1990 | U.S.S.R. | 417/298 |
| WO91/05163 | 4/1991 | WIPO | F04B 7/00 |

*Primary Examiner*—Richard A. Bertsch
*Assistant Examiner*—Ted Kim
*Attorney, Agent, or Firm*—David Kalmbaugh; Melvin Sliwka

[57] ABSTRACT

A multi-piston pump is provided which uses microprocessor controlled check ball valves to control flow rate of a fluid at the pump's outlet port. The pump includes nine cylindrical shaped chambers and associated reciprocating pistons which are driven by a cam attached to a shaft. The pump's shaft is coupled to the shaft of a motor which, in turn, drives the pump's shaft and cam resulting in a fluid, such as seawater, filling each of the nine chambers and then having the fluid forced from the chamber by the movement of its associated piston from bottom dead center to top dead center. A pressure transducer which monitors the pressure at the pump's outlet port and a shaft encoder which monitors the angular position of the pump's shaft respectively provide analog signals indicative of the pump's outlet port's pressure and the shaft's angular position. A microprocessor receives these analog signals in a digital form, processes the signals and provides digital pulse signals to either extend or retract the rod of nine solenoids depending upon the pressure at the pump's outlet port. Each of the nine solenoid rods when extended engage a check ball valve within one of the pumps nine inlet passageways allowing the passageway to remain open when the associated reciprocating piston is in a pumping stroke. This allows seawater to be discharged through the inlet passageway maintaining fluid flow at the outlet port at a pressure level which is commensurate with the intended use of the pump.

14 Claims, 4 Drawing Sheets

CONTROL SYSTEM FOR A MULTI-PISTON PUMP WITH SOLENOID VALVES FOR THE PRODUCTION OF CONSTANT OUTLET PRESSURE FLOW

BACKGROUND OF THE INVENTION

1. Field of the Invention

The present invention relates generally to a fluid driving machine. In particular, the present invention relates to a seawater pump utilizing a microprocessor to control pump output fluid flow.

2. Description of the Prior Art

In the past variable displacement piston pumps and various other fluid working machines have been used at constructions sites to assist in the construction process. When the construction sites are land based above ground sites or underground sites and it is desired to provide fluids under pressure, these prior art pumps perform quite well in providing pressurized fluids as may be utilized at the construction sites. For example, if oil driven tools such as an oil driven band saw or an oil driven drill are used at a construction site, prior art variable displacement piston pumps may be utilized as a source of power for such oil driven tools by providing pressurized oil to the tools.

While these prior art pumps are satisfactory in a land based environment, in an underwater environment such pumps are generally not useful. For example, in a deep underwater environment, such as the ocean floor, using oil driven tools can be catastrophic to the environment, especially when there is a rupture in a supply line or the pump or tools leaks oil.

Therefore, it is desirable to use a pump for operating hydraulically driven tools which uses a fluid that does not adversely effect the environment. A pump which uses sea water as the hydraulic fluid would be preferable to pumps which provides oil or other environmentally hazardous materials under pressure to operate tools. A pump providing seawater as the pressurized fluid would also be compatible with such tools as the Seawater Hydraulic Rotary Impact Tool of U.S. Pat. No. 4,977,966 and the Multi-Function Tool System Rockdrill of U.S. Pat. No. 5,060,734 which use seawater as the pressurized hydraulic fluid.

In view of the foregoing, it is an object of the present invention to provide a fluid working machine such as a pump which may be used in an underwater environment without harming the environment.

It is another object of the present invention to provide a pump which is seawater compatible and which may be used to provide pressurized seawater to seawater operated hydraulic tools.

It is still another object of the present invention to provide an axial piston seawater pump which is highly efficient, highly reliable and not susceptible to the corrosive effects of seawater.

These and other objects, novel features and advantages of the present invention will become more apparent to those skilled in the art as a more detailed description of the present invention is set forth in the detailed description of the preferred embodiment.

SUMMARY OF THE INVENTION

According to the present invention, a multi-piston fluid working machine in the form of a pump is provided which uses microprocessor controlled check ball valves to control fluid flow through the pump from its inlet port to its outlet port and thus control pressure at the pump's outlet port.

The pump of the present invention includes nine cylindrical shaped chambers and associated reciprocating pistons which are driven by a cam attached to a shaft. The pump's shaft is coupled to the shaft of a motor which, in turn, drives the pump's shaft and cam resulting in a fluid, such as seawater, filling each of the nine chambers and then having the fluid forced from the chamber by the movement of its associated piston from bottom dead center to top dead center.

The pump of the present invention also includes a pressure transducer which monitors the pressure at the pump's outlet port and a shaft encoder which monitors the angular position of the pump's shaft. The pressure transducer and shaft encoder respectively provide analog signals indicative of the pump's outlet port's pressure and the shaft's angular position. A microprocessor receives these analog signals in a digital form, processes the signals and provides digital pulse signals to either energize or de-energize the coil of nine solenoids depending upon the pressure at the pump's outlet port. Each of the nine solenoids has a rod which when the coil of its solenoid is energized extends to engage a check ball valve within one of the pumps nine inlet passageways allowing the passageway to remain open when the associated reciprocating piston is in a pumping stroke . This allows seawater to be discharged through the inlet passageway maintaining fluid pressure at the outlet port at a level which is commensurate with the intended use of the pump.

DETAILED DESCRIPTION OF THE PREFERRED EMBODIMENTS

Figure 1:
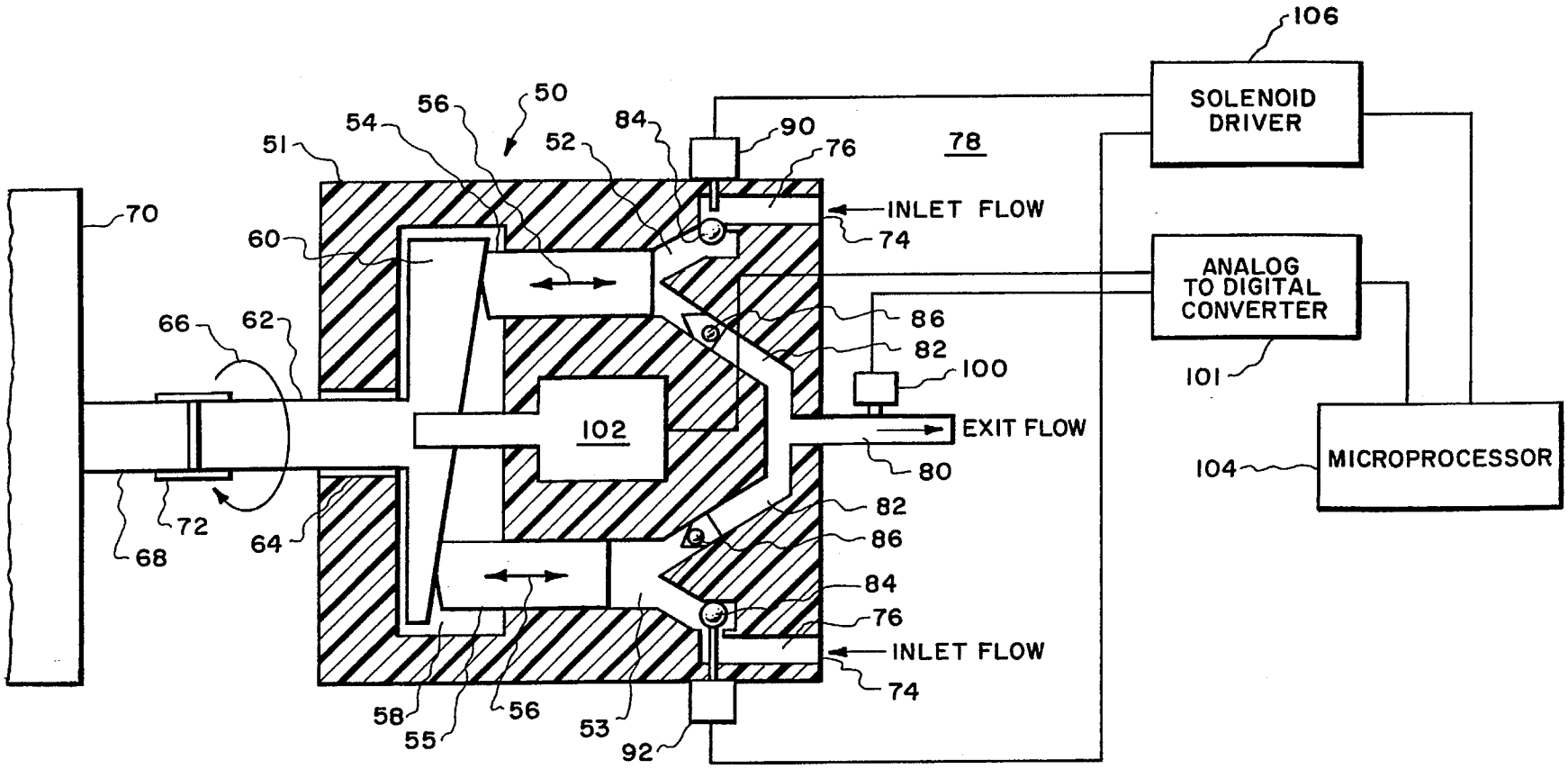
FIG. 1 is a schematic sectional view of a multi-piston pump comprising an embodiment of the present invention.

Referring now to FIG. 1, there is shown a multi-piston fluid working machine, designated generally by the reference numeral 50, which may be a fluid pump. When multi-piston fluid working machine 50 is used as a pump it may be adapted for use with hydraulically operated seawater tools.

Pump 50 includes a housing 51 having a plurality of cylindrically shaped chambers 52 and 53. There is positioned within cylindrically shaped chamber 52 a reciprocating piston 54 while there is positioned within chamber 53 a reciprocating piston 55 which is subject to reciprocal movement as is best indicated by arrows 56.

In the preferred embodiment, pump has nine cylindrical shaped chamber with each cylindrical shaped chamber having; reciprocating piston positioned within the chamber. The pump used in the preferred embodiment is a modified commercially available seawater pump, DELPUMP Model DP30.0/1000 manufactured by Composite High Pressure Technologies Inc. of Lewes Del. While the pump used in the preferred embodiment has nine cylindrical shaped chambers and associated reciprocating pistons, it should be understood by those skilled in the art that any commercially available check ball piston pump which is a seawater compatible pump may be used as pump 50 irregardless of the number of pistons included in the pump.

It should be understood that the operation of only two of the nine pistons of pump 50 and there associated chambers will be described since each piston within pump 50 operates in exactly the same manner.

Located toward the front of housing 51 is a chamber 58 which has a cam 60 rotatably mounted therein. Attached to cam 60 is one end of a shaft 62. Shaft 62 extends through a bearing 64 mounted within housing 50 which allows for rotational movement of shaft 62. The opposite end of shaft 62 is connected to the shaft 68 of a motor 70 by a coupling 72. When energized the shaft 68 of motor 70 rotates causing shaft 62 and cam 60 to rotate in clockwise direction 66.

There is located at the rear of housing 51 a plurality of inlet ports 74. Each inlet port 74 is connected to one of the plurality of chambers 52 and 53 of housing 51 by an inlet passageway 76 which allows seawater to flow from an external supply 78, such as the ocean, through the inlet port 74 to its associated chamber 52 or 53.

There is also located at the rear of housing 51 an outlet port 80. Each chamber 52 and 53 is connected to outlet port 80 by an outlet passageway 82 which allows seawater to flow from each chamber 52 and 53 within housing 51 through its associated outlet passageway 82 to outlet port 80.

Each inlet passageway 76 includes a check ball valve 84, while each outlet passageway 82 includes a check ball valve 86. The check ball valve 86 within each outlet passageway 82 prevents back flow of seawater through outlet passageway 82 whenever a piston, such as piston 55, is on a suction cycle as shown in FIG. 1.

The seawater pump 50 includes a plurality of solenoids with the solenoid mounted at the top of housing 51 being designated by the reference numeral 90 and the solenoid mounted at the bottom of housing 51 being designated by the reference numeral 92.

Figure 2:
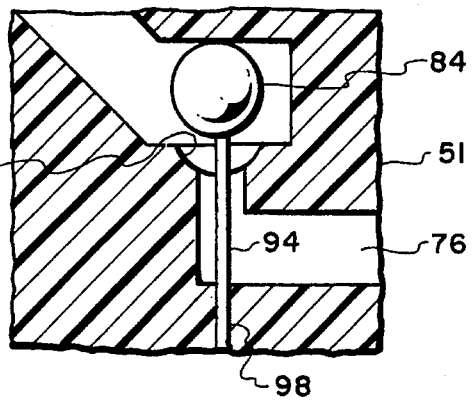
FIG. 2 is an enlarged view illustrating of one the check ball valves of the pump of FIG. 1.

Referring to FIGS. 1 and 2, each solenoid 90 and 92 has a circular rod 94 which extends through an aperture 98 within housing 51 engaging check ball valve 84 when the coil of solenoid 90 or 92 is energized as is best illustrated by FIG. 2. Energizing the coil of solenoid 90, for example, extends circular rod 94 in an upward direction (as shown in FIG. 2) so that rod 94 presses against check ball valve 84 holding inlet passageway 76 open which allows back flow of seawater through inlet passageway 76 even though cam 60 acting on piston 54 moves piston 54 in a pumping stroke as shown in FIG. 1. This, in turn, provides a means for discharging seawater from chamber 52 while maintaining the flow rate of seawater at a constant pressure through outlet port 80 of pump 50.

When the coil of solenoid 90 is de-energized rod 94 is retracted and will not engage check ball valve 84 allowing the pressure differential created by cam 60 moving piston 54 from bottom dead center to top dead center a force check ball valve 84 against valve seat 96 sealing inlet passageway 76. Sealing passageway 76 prevents seawater from being expelled from chamber 52 through inlet passageway 76 forcing the seawater within chamber 52 through outlet passageway 82 to outlet port 80.

Pump 50 includes a pressure transducer 100 coupled to outlet port 80 for monitoring the pressure of seawater flowing through outlet port 80. Pressure transducer 100 then provides a first analog signal to an analog to digital converter 101 which is indicative of the pressure at outlet port 80.

There is also coupled to shaft 62 a shaft encoder 102 which senses the angular position of shaft 62 as shaft 62 is rotating within chamber 58 of housing 51. Shaft encoder 102, which is electrically connected to analog to digital converter 101, generates a second analog signal indicative of the position of shaft 60. This second analog signal is also provided to analog to digital converter 101 which converts the first and second analog signals respectively to equivalent first and second digital signals. Analog to digital converter 101 then supplies the first and second digital signals to a microprocessor 104. After sampling, microprocessor 104 next provides a digital pulse signal which is supplied to a solenoid driver circuit 106. Solenoid driver circuit 106 includes a solenoid driver for each solenoid 90 and 92 used in the preferred embodiment of the present invention. Since pump 50 has nine inlet passageways 76 solenoid driver circuit 106 includes nine solenoid drivers with each solenoid driver being electrically connected to the coil of one of nine solenoids 90 and 92.

Figure 3:
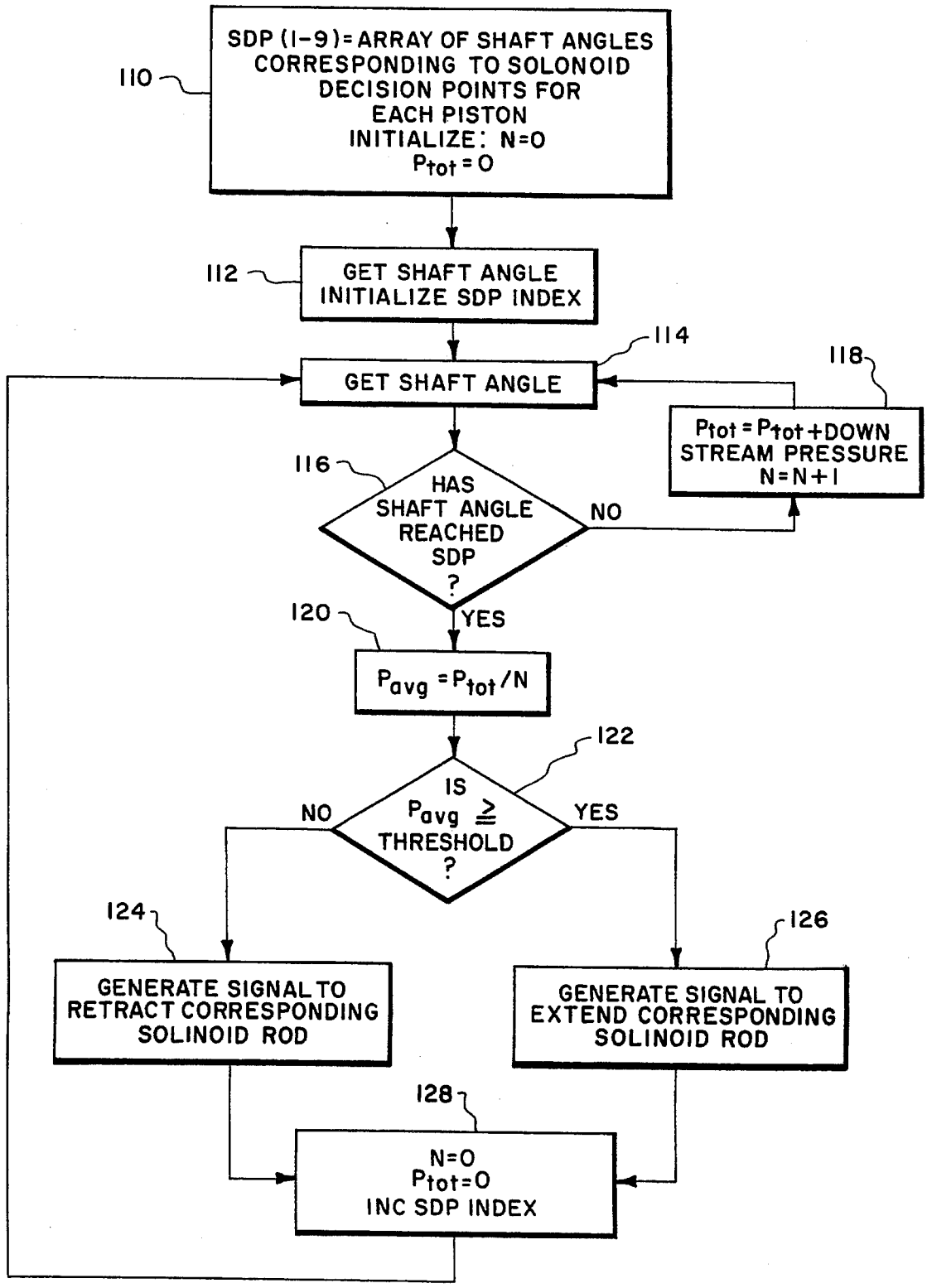
FIG. 3 is a flow chart for the microprocessor software used to control the solenoids of the pump of FIG. 1.
Figure 5:
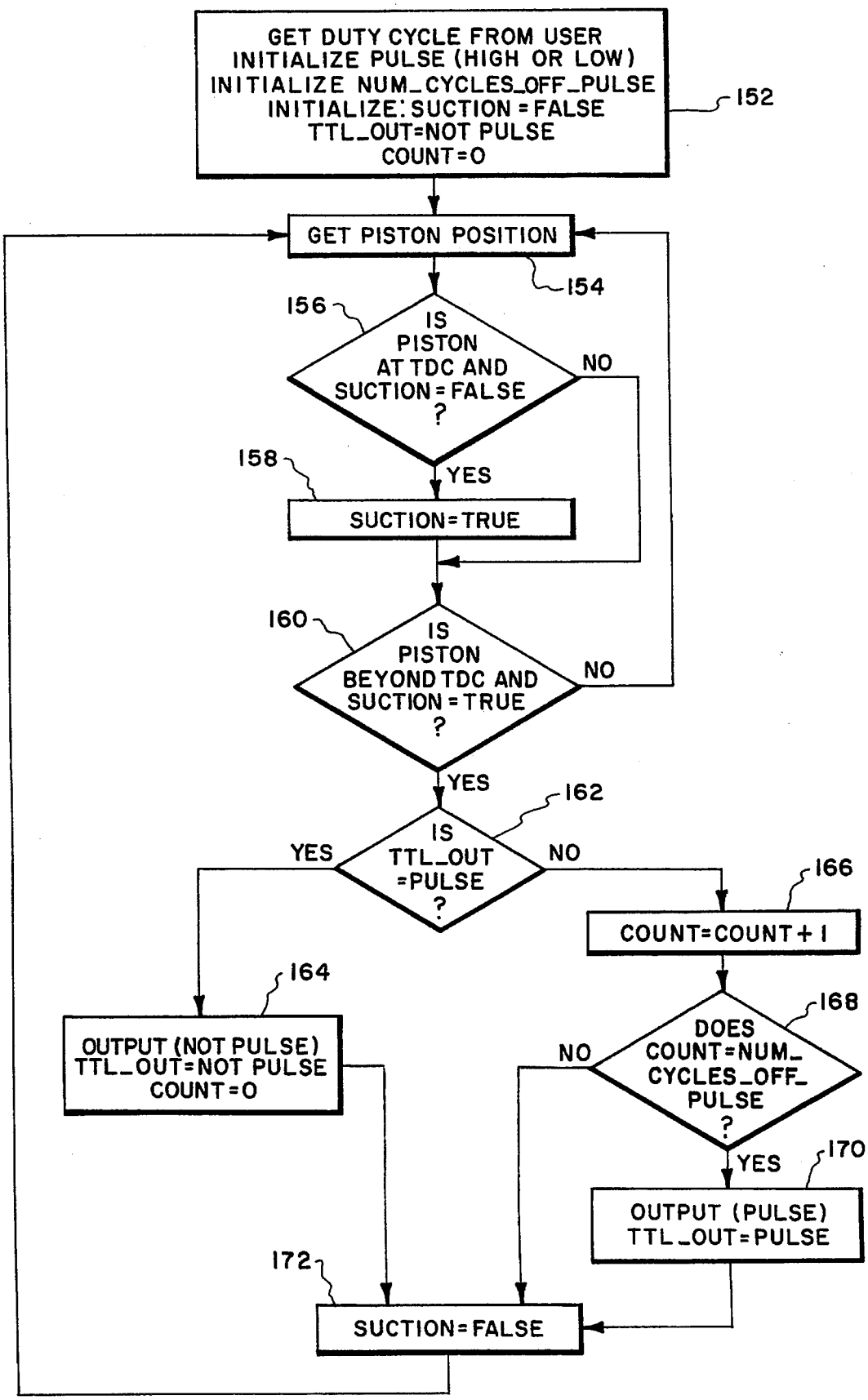
FIG. 5 is a flow chart for the microprocessor software used to control the solenoid of the pump of FIG. 4.

Referring to FIGS. 1, 2 and 3, FIG. 3 illustrates a flow chart for the software utilized by microprocessor 104 to control the solenoids utilized by pump 50. Since pump 50 uses nine reciprocating piston to pump seawater from external supply 78 to outlet port 80, microprocessor 104 will sample the pressure occurring at outlet port 80 over 40 degrees of rotation of shaft 62 and cam 60 for each of the nine reciprocating pistons used by pump 50. The following expression will then be utilized by microprocessor 104 to calculate the average pressure occurring at the outlet port 80 over the forty degrees of rotation of shaft 62 and cam 60.

$$P_{AVG} = \frac{P_{TOTAL}}{N} \tag{1}$$

where $P_{AVG}$ is the average pressure occurring at outlet port 80 for the rotation of shaft 62 over forty degrees; $P_{TOTAL}$ is the sum of the pressure measurements made by pressure transducer 100 over forty degrees of rotation of shaft 62 and N is the number of sample measurements taken by pressure transducer 100 over forty degrees of rotation of shaft 62. The computer software used by microprocessor 104 sets the sample rate at about every 0.1 millisecond so that microprocessor 104 samples the output signal from pressure transducer 100 approximately every 0.1 milliseconds over forty degrees of rotation of shaft 62 for each reciprocating piston of pump 50.

The following illustrates the operation, for example, of piston 54 and its associated solenoid 90 with respect to the computer used by microprocessor 104. It should be understood that this discussion of the operation of piston 54 and its associated solenoid 90 also applies to each of the remaining pistons of pump 50.

During program step 110 microprocessor 104 is initialized with the samples and pressure being set to a value of zero. A solenoid decision point (SDP) for each reciprocating piston of pump 50 is set during program step 110. The solenoid decision point is defined as the reciprocating piston's position at which the solenoid must be actuated so that the solenoid's rod can be extended or retracted before the piston reaches bottom dead center. The solenoid decision point, in turn, is a function of shaft rotational speed and the solenoid's response time. The position of each of the nine pistons of pump 50 is determined by using the shaft angular position data provided by shaft encoder 102.

During program step 110, the software for microprocessor 104 calculates the solenoid decision point for each of the nine reciprocating pistons of pump 50. At each of the nine solenoid decision points, microprocessor 104 will either energizes or de-energize one of coils of the nine solenoids of pump 50, extending or retracting its circular rod 94. The solenoid to be actuated by microprocessor 104 is the solenoid associated with the next piston to reach bottom dead center.

For example, when shaft 62 is at an angular position which corresponds to the solenoid decision point for piston 54 microprocessor 104 will provide a digital pulse signal to solenoid driver circuit 106 which will either energize or de-energize the coil of solenoid 90 which, in turn, extends or retracts the circular rod 94 of solenoid 90. The microprocessor's 104 decision to energize or de-energize the coil of solenoid 90 is dependent upon the value of $P_{AVG}$ of equation 1. The coil of solenoid 90 will remain energized for one revolution of shaft 62 at which time a new value for $P_{AVG}$ is calculated.

At this time it should be noted that the angle of rotation of shaft 62 over which $P_{AVG}$ is calculated is a function of the number of reciprocating pistons. When, for example, a pump has six reciprocating pistons $P_{AVG}$ is calculated over sixty degrees of rotation for the pump's shaft.

It should be noted that the angular difference between the solenoid decision point and bottom dead center for each reciprocating piston of pump 50 is a function of the pump's speed and the time required to energize each of the pump's solenoids. This difference remains constant for each solenoid of pump 50. For example, a high speed pump may require a large angular difference between the solenoid decision point and bottom dead center for each piston of the pump.

As an example, the solenoid decision point of piston 54 for a solenoid having a fast response time and/or a low speed pump may be set at fifteen degrees of rotation of shaft 62 before piston 54 of pump 50 reaches bottom dead center. Alternatively, if the solenoid's response time is slow and/or the pump is a high speed pump, the solenoid decision point of piston 54 may be set at thirty degrees of rotation of shaft 62 before piston 54 of pump 50 reaches bottom dead center.

When motor 70 is energized shaft 62 may be at any angular position. During program step 112 microprocessor 104 determines the angular position of shaft 62 at start up of pump 50, compares this angular position with the solenoid decision point for each of the nine pistons of pump 50 and determines which solenoid is next to be controlled. The angular position of shaft 62 is, in turn, provided by shaft encoder 102 to microprocessor 104 via analog to digital converter 101.

For the purpose of illustrating program steps 112–128 of the flow chart of FIG. 3 it may be assumed that microprocessor 104 has determined that the solenoid decision point for reciprocating piston 54 is the next solenoid decision point after pump start up.

During program steps 114, 116 and 118 microprocessor 104 determines the angular position of shaft 62 (program step 114) and if the angular position of shaft 62 has not reached the solenoid decision point for reciprocating piston 54 microprocessor 104, will continue to increment the 0.1 milliseconds pressure data samples from pressure transducer 100, that is microprocessor 104 determines $P_{TOTAL}$. When the angular position of shaft 62 reaches the solenoid decision point for reciprocating piston 54, microprocessor 104 calculates $P_{AVG}$ (program step 120).

Microprocessor 104 has a threshold pressure stored therein which is dependent upon the pressure required at outlet port 80. This, in turn, is dependent upon the application of pump 50. For example, if pump 50 is to supply pressurized seawater to a band saw which has a pressure requirement of about 800 psi, the threshold pressure stored in microprocessor 104 is 800 psi.

When $P_{AVG}$ exceeds 800 psi (program step 122) and the angular position of shaft 62 is at the solenoid decision point, microprocessor 104 supplies a digital pulse signal to solenoid driver 106 which energizes the coil of solenoid 90 extending circular rod 94 which holds check ball valve 84 in the open position illustrated in FIG. 2 (program step 126). Check ball valve 84 remains in the open position illustrated in FIG. 2 for one revolution of shaft 62 until $P_{AVG}$ is again calculated by microprocessor 104. During program step 128 pressure is reset equal to zero, the number of samples is reset to zero and the solenoid decision point index is incremented.

If $P_{AVG}$ is less than 800 psi and the angular position of shaft 62 is at the solenoid decision point circular rod 94 of solenoid 90 is retracted allowing check ball valve 84 to close inlet passageway 76 when the pressure at inlet prot 76 is less than the pressure within chamber 52 of pump 50. This, in turn, allows pump 50 to maintain a pressure of about 800 psi at outlet port 80.

Generally the pressure at outlet port 80 will be in a range of between 500 psi to 1500 psi depending upon the particular use of pump 50.

Figure 4:
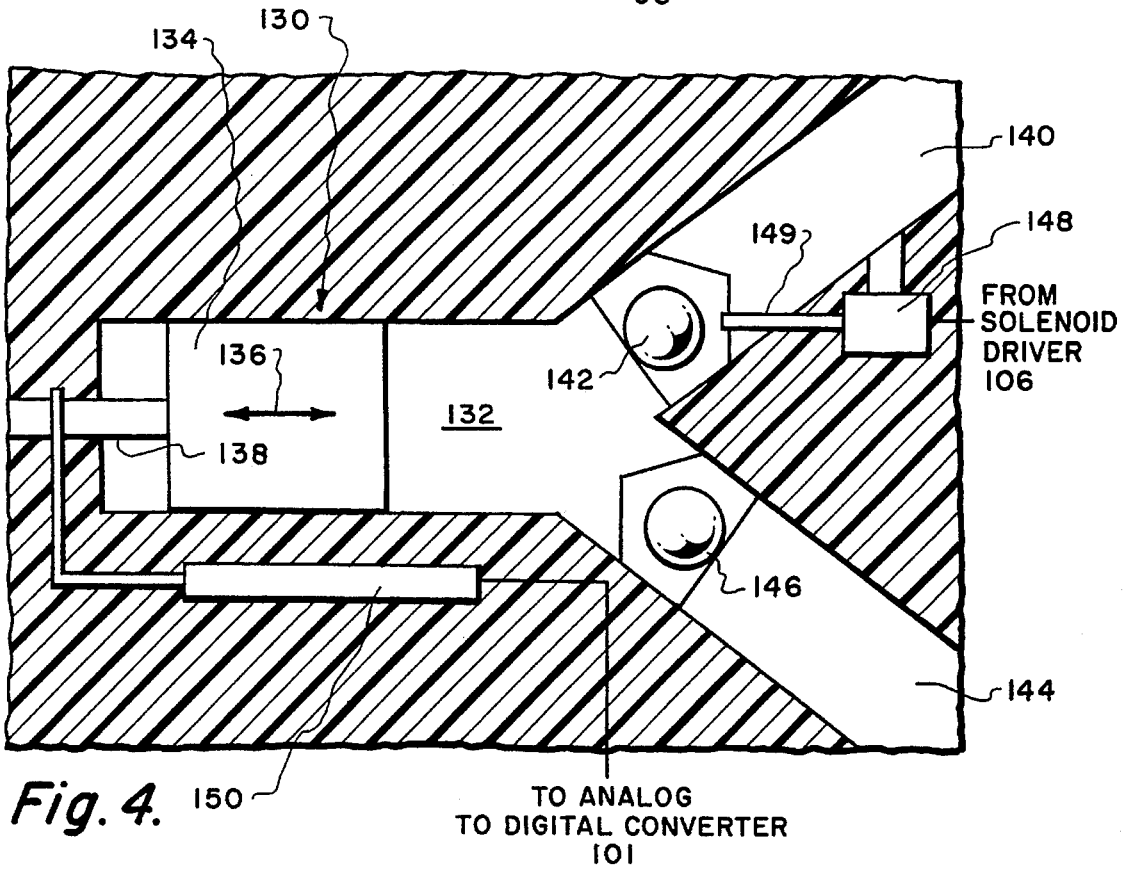
FIG. 4 is a sectional view of a single piston pump which comprises an alternative embodiment of the present invention.

Referring to FIG. 4 there is shown a single piston pump, designated generally by the reference numeral 130. Pump 130 has a cylindrical shaped chamber 132 and reciprocating piston 134 positioned in chamber 132 which is subject to reciprocal movement as is best indicated by arrows 136. A rod 138 attached to piston 134 drives piston 134 from bottom dead center to top dead center and then returns piston 134 to bottom dead center.

One end of the inlet passageway 140 of pump 130 includes a check ball valve 142 which prevents back flow of seawater through inlet passageway 140 to the external supply when the pressure within chamber 132 is greater than the pressure within inlet passageway 140. One end of the outlet passageway 144 of pump 130 also includes a check ball valve 146 which prevents back flow of seawater through outlet passageway 140 to chamber 132.

A linear variable displacement transducer 150 is connected to rod 138 to monitor the piston position as rod 138 drives piston 134 in the reciprocating motion indicated by arrow 136. Linear variable displacement transducer 150 then provides a 0–10 VDC which is indicative of the piston position. This signal is supplied to analog to digital converter 101, FIG. 1, which converts the signal to a digital form for processing by microprocessor 104, FIG. 1.

Referring to FIGS. 1, 4, 5 and 6, FIG. 5 illustrates the operation of the software of Appendix A. The system is initialized during program step 152 and the duty cycle is selected. The software of Appendix A includes the following user selectable duty cycles: 25%, 33%, 50%, 66%, 75% and 100%. For purposes of illustration a 50% duty is selected.

During program step 154 the position of reciprocating piston 134 within chamber 132 is supplied by linear variable displacement transducer 150 to microprocessor 104.

At this time it should be noted that the coil of solenoid 148 is energized only during a suction stroke which results in the circular rod 149 of solenoid 148 being extended during the suction stroke. The circular rod 149 of solenoid 148 then engages the check ball valve 142 keeping the valve open during a pumping stroke resulting in discharge of seawater through the inlet passageway 140 of pump 130 during the pumping stroke. When the user of pump 130 selects a 50% duty cycle, solenoid 148 is energized for a pumping stroke on alternative cycles as is best illustrated by the timing waveforms of FIG. 6. This, in turn, allows discharge through inlet passageway 140 during alternative cycles reducing the flow of seawater flowing through outlet passageway 144. If the user desires to select a duty cycle of 25% the software of Appendix A will extend the rod 149 of solenoid 148 one in every four cycles, thereby allowing back flow through inlet passageway 140 one in every four positive-negative pressure cycles.

Figure 6:
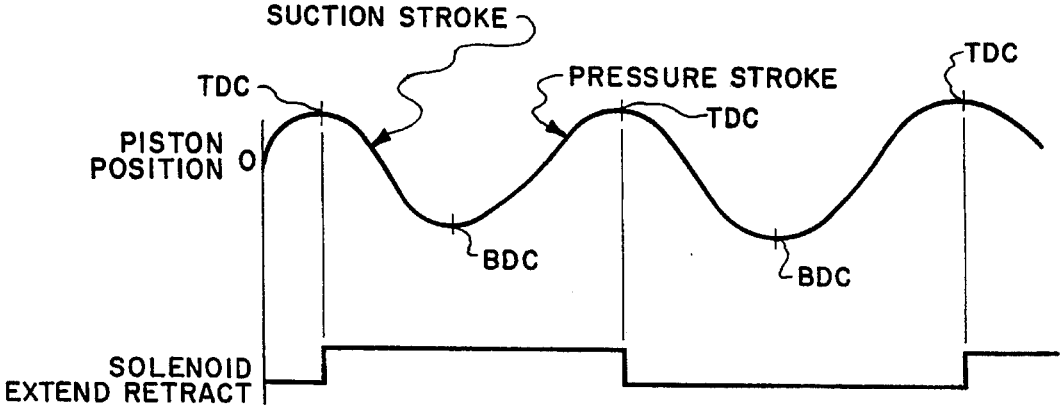
FIG. 6 are timing waveforms illustrating a control cycle for the solenoid of the pump of FIG. 4 as a function of piston position.

During program step 156, the software of Appendix A determines whether piston 134 is at top dead center by sampling the output of linear variable displacement transducer 150 and also determines whether a suction flag is set false. If the suction flag is set false then a pumping/pressure stroke is occurring and the pressure within chamber 132 is positive as shown in FIG. 6.

When the piston 134 arrives at top dead center then the suction flag is set true (program step 158). Program step 160 determines whether piston 134 is past top dead center as shown in the sinusoidal waveform of FIG. 6 and also whether the suction flag is set true. This is the solenoid decision point. It should be noted that the rod 149 of solenoid 148 is extended or retracted at the solenoid decision point.

When piston 134 reaches the solenoid decision point, the software of Appendix A proceeds to program step 162. During program step 162 the software of Appendix A determines whether pulse or not pulse was output at the previous solenoid decision point. If the user selects a 50% duty cycle as shown FIG. 6, and pulse was previously output at the solenoid decision point, the software of Appendix A will set not pulse which is a low signal provided to solenoid driver 106. Solenoid driver 106 then de-energizes the coil of solenoid 148 retracting rod 149 (program step 164) as shown in FIG. 6. In addition, program step 164 sets a TTL_OUT flag to not pulse and also sets an internal counter to zero with the counter counting the number of times not pulse occurs. It should be noted that the software of Appendix A is written such that for duty cycles of 50% or less pulse extends rod 149, while for duty cycles greater than 50% pulse retracts rod 149.

The software of Appendix A proceeds to program step 172 setting the suction flag false and then the software of Appendix A proceeds through program steps 154–162 until linear variable displacement transducer 150 senses another solenoid decision point. If pulse was not output at the prior solenoid decision point (program step 162) the software of Appendix A proceeds to program step 166 and the count is incremented.

The software of Appendix A next proceeds to program step 168 during which it is determined whether the count equals the number of cycles during which a pulse is not present. For a 50% duty cycle a count of one, that is one cycle, is required for the software of Appendix A to proceed to program step 170 during which the coil of solenoid 148 is energized extending arm 149. For a 25% duty cycle a count of three, that is three cycles are required before TTL_OUT is set equal to pulse which energizes the coil of solenoid 148 extending arm 149 (program step 170). During program step 170 microprocessor 104 also sets the TTL_OUT flag to pulse.

From the foregoing description, it may readily be seen that the present invention comprises a new, unique and exceedingly useful seawater pump for maintaining a constant pressure at its output which constitutes a considerable improvement over the known prior art. Obviously many modifications and variations of the present invention are possible in light of the above teachings. It is therefore to be understood that within the scope of the appended claims the invention may be practiced otherwise than as specifically described.

Appendix A

```
/*************************************************************************/
/*    Title:      sgkey.c  handles soft key functions                    */
/*                NCEL                                                   */
/*                date: jun 10 1993                                      */
/*                author: roman v. Kruchowy                              */
/*                                                                       */
/*************************************************************************/


#include "g.h"
#include <bios.h>
#include <conio.h>
#include <process.h>
#include <values.h>


extern void interrupt(*old_clk_int)();


enum {graph_off,graph_on} graph_sw=graph_on;
enum {adchk_off,adchk_on} adchk_sw;


char *whyS [] =
{
    "argument domain error",
    "argument singularity ",
    "overflow range error ",
    "underflow range error",
    "total loss of significance",
    "partial loss of significance"
};


/************      reads keyboard  input      **************/

key()
{
int input;
input = getkey();
switch(input){
   case F5 :
      break;
   case F4 :
      break;

   case DOWNKEY :
      d_time_dec();
```

```
      break;
   case UPKEY :
      d_time_inc();
      break;
   case ALTF1 :
      adchk_toggle();
      break;
   case F9 :
      quit();
      break;
   case 'd':
   case 'D':  printf("                          down\r"); outport(B_PORT,0xff); break;
   case 'u':
   case 'U':  printf("                          up  \r"); outport(B_PORT,0x00); break;
      }
}


char *query_box[]={            /* screen coordinates in sbkey.c  **************/
"╔═══Query Box═══════════════╗",
"╚═══data acquistion suspended!!═══╝"};

/**********************                                  ****************/
draw_query()
{
char i;
textattr(0x5f);
for(i=0;i<4;i++){
      gotoxy(23,i+14);
      cputs(query_box[i]);
      }
}

extern unsigned int d_time;
#define MAX_DELAY 1000
/*******************   increases sample window size        **************/
d_time_inc()
{
if(d_time<MAX_DELAY)d_time+=50;
else d_time+=10;
gotoxy(60,1);
cprintf("delay time %3d",d_time);

}


/******************* decreases sample window size         ***************/
d_time_dec()
{
if(d_time>10)d_time-=50;
gotoxy(60,1);
cprintf("delay time %3d",d_time);

}
```

```
/**********  refreshes screen display incase of spill over  **************/
refresh()
{
textattr(0x0f);
clrscr();
box_write();
}

/*****************                                          **************/

quit()
{
char ch;
draw_query();
gotoxy(24,15);
cputs("Are you sure you want to quit");
gotoxy(24,16);
cputs("      (Y or N) ? ");
ch=getch();
if(ch=='Y'|| ch=='y'){
      outportb(0x21,0x80|inportb(0x21));  /* mask out IRQ7 clk-a/d interrupts  */
      setvect(0x0f,old_clk_int);
      clrscr();
      fcloseall();
      exit(1);
      }
refresh();
}


/******************** turns on/off ad display to screen   ****************/
adchk_toggle()
{
ad_box();
adchk_sw=(adchk_sw==adchk_on) ? adchk_off : adchk_on;
if(adchk_sw==adchk_off)refresh();
}



char *null_box[]={"\r"};

struct BOX box[]={      /*name,col,line*/
{null_box,  1,1},      /* 0 */
};


/****************************   draws various display boxes   ****************/
box_write()
{
char i,j,*temp_ptr,nbr_boxes;
nbr_boxes=sizeof(box)/sizeof(struct BOX);
for( j=0;j<nbr_boxes;j++){
      i=0;
```

```
        temp_ptr=*box[j].box_ptr;
        while(*temp_ptr!='\r'){
                gotoxy(box[j].col,i+box[j].line);
                cputs(temp_ptr);
                temp_ptr=temp_ptr+strlen(temp_ptr)+1;
                i++;
                }
        }
}

/********************** writes raw A/D readings to screen *****************/
ad_box()
{
char i;

textattr(0x0f);
gotoxy(1,1);
cputs(
"╔═A/D═Voltage═══╗");
for(i=0;i<16;i++){
gotoxy(1,2+i);
cputs(
"╟                    ╢");
}
gotoxy(1,18);
cputs(
"╚═══════════════════╝");
}


/************************** handles math errors   **********************/
int matherr (struct exception *e)
{
gotoxy(1,1);
//cprintf("message:%s (%8g,%8g): %s\n", e->name, e->arg1, e->arg2,
//                        whyS [e->type - 1]);
if (e->type == DOMAIN){
        e->retval=1.0;
        return(1);
        }
if (e->type == UNDERFLOW){
        /* flush underflow to 0 */
        e->retval = MINDOUBLE;
        return (1);
        }
if (e->type == OVERFLOW){
        /* flush underflow to 0 */
        e->retval = MAXDOUBLE;
        return (1);
        }
if (e->type == TLOSS){
        /* total loss of precision, but ignore the problem */
        return(1) ;
        }
return (1);
}
```

```
/******** Uses the BIOS to read the next keyboard character **********/
int getkey(void)
{
 int key, lo, hi;
 key = bioskey(0);
 lo = key & 0X00FF;
 hi = (key & 0XFF00) >> 8;
 return((lo == 0) ? hi + 256 : lo);
}
```

```
#define TES
/*************************************************************************/
/*      Title:  duty.c   main program- initialize,data output            */
/*                       NCEL                                            */
/*                       date: jun 10 1993                               */
/*                       author: roman v. Kruchowy (modified by j. massey) */
/*                                                                       */
/*************************************************************************/

#include "g.h"
#include <stdlib.h>
#include <conio.h>

float ain(unsigned char chan);
unsigned char port_in();
void d2aout(unsigned int ival,unsigned int chnl);
extern enum {adchk_off,adchk_on} adchk_sw;
extern enum {graph_off,graph_on} graph_sw;


typedef struct {                                        /*  structure for d/a  accessing
*/
     unsigned int byte1 : 8;
     unsigned int byte2 : 8;
       } d2abyte;

union {
     struct
            {                                                          /* d/a union
*/
      unsigned data : 12;             /* output data */
      unsigned chnl : 2;              /* channel */
      unsigned gain : 2;              /* gain */
      } d2afields;
       d2abyte  byte_data;
     } d2aoutword;


struct tm *time_now;
long secs_now;
char    *time_str;


long oldtime,newtime;
unsigned char counter;
unsigned char input,chan;
float ad_value;
float new_value1,new_value2,new_value3,slope;
unsigned int d_time=200;
unsigned char num_cyc_off_pulse, pulse, rising=FALSE, TTL_out=0x00, count=0;

/******      MAIN    PGM  ******************************/

main(int argc,char *argv[])

{
switch (atoi(argv[1]))
```

```
{
  case 25: num_cyc_off_pulse=3; pulse=0xff; break;
  case 33: num_cyc_off_pulse=2; pulse=0xff; break;
  case 50: num_cyc_off_pulse=1; pulse=0xff; break;
  case 66: num_cyc_off_pulse=2; pulse=0x00; break;
  case 75: num_cyc_off_pulse=3; pulse=0x00; break;
  case 100: num_cyc_off_pulse=200; break;
  default: printf("Duty Cycle must be 25, 33, 50, 66, 75, or 100\n"); return;
}

textattr(0x1f);
get_time();
clrscr();
gotoxy(1,1);
set_rtc();                /* set up clock on the ADC 300 board*/
install_analog(analog,0x0f);    /* install the A/D interrupt via RTC     */
init_ad();                /* initialize the ADC 300 board etc      */
ctrlbrk(c_break);                /* disable control break                    */
d2aout(2000,1);           // supply power to select switch

if (num_cyc_off_pulse == 200)
{
  for(outport(B_PORT,0xff),printf("\n\n\n\n\n\n\n\n\n\n
down\r");;)
    if (kbhit()) key();
}

else

while(TRUE){
      ad_value=ain(0);
      gotoxy(1,1);
      cprintf("%2d  %3.3f",chan,ad_value);

if(ad_value <-6.0 && !rising) rising=TRUE;

if(ad_value >0.0 && rising)
{
  if (TTL_out == pulse)
  {
    outport(B_PORT,~pulse);
    TTL_out = ~pulse;
    count = 0;
  }
  else if (++count==num_cyc_off_pulse)
  {
    outport(B_PORT,pulse);
    TTL_out = pulse;
  }
  rising=FALSE;
}
if(kbhit()) key();
} //end of while()
} //end of main()

/**** read port A ****/
unsigned char port_in(){
```

```
return(inportb(A_PORT));
}

/***  converts data samples to engineering units,avg,rms,min etc ********/
data_calc()
{
new_data_flag=FALSE;
if(adchk_sw==adchk_on) write_adchk();
}

/******************* ctrl C  processor  *****************/
int c_break(void)
{
return(1);                        /*  resume program execution    */
}


/**********    d/a output ********************************************/
void d2aout(unsigned int ival,unsigned int chnl)
{
      d2aoutword.d2afields.chnl = chnl;
      d2aoutword.d2afields.data = ival;
      outportb(DA_LO,d2aoutword.byte_data.byte1);
      outportb(DA_HI,d2aoutword.byte_data.byte2);
}

/********************** a/d display of all channels ***************/
write_adchk()
{
char i;
textattr(0x0f);
for(i=0;i<=15;i++){
      gotoxy(3,2+i);
      cprintf("%2d   %3.3f",i,((adch[i])/204.8-10.));
      }
}

/*****************                                          **************/
get_time()
{
char *ptr;
long temp;
time(&secs_now);                  /* get time in seconds */
time_now=localtime(&secs_now);    /* put in structure */
newtime=secs_now;
}

/************************ analog input reading *******************/
float ain(unsigned char chan){
unsigned char low_bits,hi_bits;
signed int adch;
float value;
d2aout(2000,1);
inportb(AD_LO_DATA);              /* clear EOC if set for some reason      */
outportb(AD_CTRL,((chan&0x0f)|0x80));   /*  conversion start next ch   */
while(!(0x40&inportb(AD_STAT))); /*  wait for EOC to go 1    */
low_bits=inportb(AD_LO_DATA);
```

```
hi_bits =0x0f&inportb(AD_HI_DATA);
adch  =hi_bits;
adch<<=8;
adch +=low_bits;
value=(adch/204.8-10.);
d2aout(0,1);
return(value);
}
```

```
#define TES

/*************************************************************************/
/*    Title:      sgclk.c           handles a/d and rtc interrupts          */
/*                NCEL                                                      */
/*                date: jun 10 1993                                         */
/*                author: roman v. Kruchowy                                 */
/*                                                                          */
/*************************************************************************/


#include "g.h"

#define SAMPLE_PERIOD    1          /* tenths of seconds between A/D scans */

extern enum log log_sw;                          /* sbkey.c */

void install_analog(void interrupt (*faddr) (), int inum);
void interrupt analog();
void interrupt (*old_clk_int)();    /* storage for old vector  */


unsigned char clk_counter,data_buff,array_index,current_buffer,buff_full_flag;
unsigned char new_data_flag;
unsigned int ad_counter;
unsigned int ctr0_old_rdg,ctr1_old_rdg;
unsigned long ctr0_total,ctr1_total,tenth_ctr,total_clk_counter;
unsigned int adch[16];

/**********   sets up RTClk in the ADC 300         *********************/
set_rtc()
{
outportb(CLK_SEC,(char)bin2bcd(time_now->tm_sec ));
outportb(CLK_MIN,(char)bin2bcd(time_now->tm_min ));
outportb(CLK_HR ,(char)bin2bcd(time_now->tm_hour));

}


/*********************************************************************
     bin2bcd()
     This function converts a integer to a 4 digit BCD form.  Integer
     greater then 4 digits will return the last 4 digits.  Integer less
     then zero (negative) will return 0.
*********************************************************************/
int bin2bcd(ival)
unsigned int ival;
{
unsigned int bcd=0, i=0;

     while ((ival>0) && (i<16))
```

```
      {
      bcd = bcd | ((ival%10)<<i);
      ival = ival / 10;
      i = i + 4;
      }
     return(bcd);
}

/*********************************************************************
     bcd2bin()
     This function converts a 4 digit BCD to a binary integer.
*********************************************************************/
unsigned int bcd2bin(bcd)
unsigned int bcd;
{
int ival=0,i=1;

     while (bcd != 0)
      {
      ival = ival +  (bcd & 0x000f) * i;
      bcd = bcd >> 4;
      i = i * 10;
      }
     return(ival);
}


/******************** initialize STP-2M   interface board          */
init_ctr()
{
outportb(CTR_SELECT,0x80);          /* 0xc0 TTL,0x80 opto up/down   counter */
outportb(CTR0_LO,0x00);             /* initialize counters to zero     */
outportb(CTR0_HI,0x00);
outportb(CTR1_LO,0x00);
outportb(CTR1_HI,0x00);
}

/*************    initializes A/D ADC300    *********************/

init_ad()
{
outportb(0x20,0x20);     /*  issue EOI end of interrupt to 8259 */
outportb(AD_GAIN,0x00); /*  gain set to X1  */
outportb(AD_CTRL,0x00); /* set channel to 0 */
outportb(AD_MODE,0x00);  /* conversion initiated by software */
inportb(CLK_STAT);  /* read clk status     reset interrupt  */
outportb(CLK_INT_CTRL,0x02); /* clk interrupt every .1 sec */
outportb(PORT_CTRL,0x90); // output=port C,B  input=port A
outportb(0x21,0x7f&inportb(0x21));  /* mask in IRQ7 interrupt */
}

void install_analog(void interrupt (*faddr) (), int inum)
```

What is claimed is:

1. A multi-piston pump comprising:

a housing having a plurality of cylindrical shaped chambers, each of said cylindrical shaped members having an inlet passageway connecting said cylindrical shaped chamber to an external supply of a fluid and an outlet passageway connecting said cylindrical shaped chamber to an outlet port of said housing;

a plurality of reciprocating pistons, one of said reciprocating pistons being positioned within a corresponding one of said cylindrical shaped chambers, each of said reciprocating pistons being adapted for reciprocating movement;

a cam mounted within said housing, said cam being mounted within said housing to allow for rotational movement of said cam within said housing;

a shaft having one end connected to said cam and an opposite end connected to a drive source, said drive source imparting rotational movement upon said shaft and said cam;

encoder means coupled to said shaft, said encoder means measuring an angular position of shaft and providing a first analog signal indicative of the angular position of said shaft;

said cam driving each of said reciprocating pistons from a bottom dead center position to a top dead center position within the corresponding one of said cylindrical shaped chambers for each of said reciprocating pistons forcing said fluid from the corresponding one of said cylindrical shaped chamber;

a plurality of check ball valves, one of said check ball valves being positioned within a corresponding one of said inlet passageways;

a plurality of solenoids mounted on said housing, each of said solenoids having a rod extending from said solenoid through an aperture within said housing;

pressure monitoring means positioned at the outlet port of said housing for monitoring a pressure of said fluid at the outlet port of said housing, said pressuring monitoring means providing a second analog signal indicative of the pressure of said fluid at the outlet port of said housing;

processing means for receiving said first and said second analog signals and calculating an average pressure over a predetermined angle of rotational movement of said shaft for each of said solenoids;

said processing means calculating said average pressure in accordance with the following equation:

$$P_{AVG} = \frac{P_{TOTAL}}{N}$$

wherein $P_{AVG}$ is said average pressure occurring at the outlet port of said housing for a rotation of said shaft over said predetermined angle of rotational movement; $P_{TOTAL}$ is a summation of pressure measurements made by said pressure monitoring means over said predetermined angle of rotational movement and N is a predetermined number of sample measurements taken by said pressure monitoring means over said predetermined angle of rotational movement;

said processing means actuating each of said solenoids for one revolution of said shaft at a corresponding solenoid decision point for each of said solenoids whenever said average pressure exceeds a predetermined threshold pressure level;

the rod of each of said solenoids being actuated extending to engage said check ball valve within the corresponding one of said inlet passageways allowing said fluid to be discharged through the corresponding one of said inlet passageways maintaining the pressure of said fluid at the outlet port of said housing at about said predetermined pressure level.

2. The multi-piston pump of claim 1 predetermined threshold pressure level is selected from a range of about 500 psi to about 1500 psi.

3. The multi-piston pump of claim 1 wherein said fluid comprises seawater.

4. The multi-piston pump of claim 1 wherein said predetermined number of sample measurements taken by said pressure monitoring means over said predetermined angle of rotational movement of said shaft is about one thousand sample measurements.

5. A multi-piston pump comprising:

a housing having nine cylindrical shaped chambers, each of said cylindrical shaped members having an inlet passageway connecting said cylindrical shaped chamber to an external supply of a fluid and an outlet passageway connecting said cylindrical shaped chamber to an outlet port of said housing;

nine reciprocating pistons, one of said nine reciprocating pistons being positioned within a corresponding one of said nine cylindrical shaped chambers, each of said nine reciprocating pistons being adapted for reciprocating movement;

a cam mounted within said housing, said cam being mounted within said housing to allow for rotational movement of said cam within said housing;

a shaft having one end connected to said cam and an opposite end connected to a drive source, said drive source imparting rotational movement upon said shaft and said cam;

encoder means coupled to said shaft, said encoder means measuring an angular position of shaft and providing a first analog signal indicative of the angular position of said shaft;

said cam driving each of said nine reciprocating pistons from a bottom dead center position to a top dead center position within the corresponding one of said cylindrical shaped chambers for each of said reciprocating pistons forcing said fluid from the corresponding one of said cylindrical shaped chamber;

nine check ball valves, one of said nine check ball valves being positioned within a corresponding one of said nine inlet passageways;

nine solenoids mounted on said housing, each of said nine solenoids having a rod extending from said solenoid through an aperture within said housing;

pressure monitoring means positioned at the outlet port of said housing for monitoring a pressure of said fluid at the outlet port of said housing, said pressuring monitoring means providing a second analog signal indicative of the pressure of said fluid at the outlet port of said housing;

converter means for receiving said first and said second analog signals, said converter means converting said first and said second analog signals respectively to first and second digital equivalent signals; and digital signal processing means for receiving said first and said second digital equivalent signals and calculating an average pressure for each of said nine solenoids over an angle of rotational movement of said shaft of about forty degrees;

said digital signal processing means calculating said average pressure in accordance with the following equation:

$$P_{AVG} = \frac{P_{TOTAL}}{N}$$

wherein $P_{AVG}$ is said average pressure occurring at the outlet port of said housing for a rotation of said shaft over said angle of rotational movement of about forty degrees; $P_{TOTAL}$ is a summation of pressure measurements made by said pressure monitoring means over said angle of rotational movement of about forty degrees and N is a predetermined number of about one thousand sample measurements taken by said pressure monitoring means over said angle of rotational movement of about forty degrees;

said digital signal processing means actuating each of said solenoids for one revolution of said shaft at a corresponding solenoid decision point for each of said nine solenoids;

said solenoid being actuated whenever said average pressure calculated for said solenoid over said angle of rotational movement of said shaft exceeds a predetermined threshold pressure level;

the rod of each solenoid being actuated extending to engage said check ball valve within the corresponding one of said nine inlet passageways allowing said fluid to be discharged through the corresponding one of said nine inlet passageways maintaining the pressure of said fluid at the outlet port of said housing at about said predetermined threshold pressure level.

6. The multi-piston pump of claim 5 wherein said encoder means comprises a shaft encoder.

7. The multi-piston pump of claim 5 wherein said converter means comprises an analog-to-digital converter.

8. The multi-piston pump of claim 5 wherein said digital signal processing means comprises a microprocessor.

9. The multi-piston pump of claim 5 wherein said predetermined threshold pressure level is selected from a range of about 500 psi to about 1500 psi.

10. The multi-piston pump of claim 5 wherein said pressure monitoring means comprises a pressure transducer.

11. The multi-piston pump of claim 5 wherein said fluid comprises seawater.

12. A multi-piston pump comprising: a housing having nine cylindrical shaped chambers, each of said cylindrical shaped members having an inlet passageway connecting said cylindrical shaped chamber to an external supply of a fluid and an outlet passageway connecting said cylindrical shaped chamber to an outlet port of said housing;

nine reciprocating pistons, one of said nine reciprocating pistons being positioned within a corresponding one of said nine cylindrical shaped chambers, each of said nine reciprocating pistons being adapted for reciprocating movement;

a cam mounted within said housing, said cam being mounted within said housing to allow for rotational movement of said cam within said housing;

a shaft having one end connected to said cam and an opposite end connected to a drive source, said drive source imparting rotational movement upon said shaft and said cam;

a shaft encoder coupled to said shaft, said shaft encoder measuring an angular position of shaft and providing a first analog signal at an output of said shaft encoder, said first analog signal being indicative of the angular position of said shaft;

said cam driving each of said nine reciprocating pistons from a bottom dead center position to a top dead center position within the corresponding one of said cylindrical shaped chambers for each of said reciprocating pistons forcing said fluid from the corresponding one of said cylindrical shaped chamber;

nine check ball valves, one of said nine check ball valves being positioned within a corresponding one of said nine inlet passageways;

nine solenoids mounted on said housing, each of said nine solenoids having an input and a rod extending from said solenoid through an aperture within said housing;

a pressure transducer positioned at the outlet port of said housing for monitoring a pressure of said fluid at the outlet port of said housing, said pressure transducer having an output for providing a second analog signal indicative of the pressure of said fluid at the outlet port of said housing;

an analog-to-digital converter having a first input connected to the output of said shaft encoder, a second input connected to the output of said pressure transducer and an output, said analog-to-digital converter receiving said first and said second analog signals and converting said first and said second analog signals respectively to first and second digital equivalent signals;

a digital signal processor having an input connected to the output of said analog-to-digital converter and an output, said digital signal processing means receiving said first and said second digital equivalent signals, and calculating an average pressure for each of said nine solenoids over an angle of rotational movement of said shaft of about forty degrees;

said digital signal processor calculating said average pressure in accordance with the following equation:

$$P_{AVG} = \frac{P_{TOTAL}}{N}$$

wherein $P_{AVG}$ is said average pressure occurring at the outlet port of said housing for a rotation of said shaft over said angle of rotational movement of about forty degrees; $P_{TOTAL}$ is a summation of pressure measurements made by said pressure transducer over said angle of rotational movement of about forty degrees and N is a predetermined number of about one thousand sample measurements taken by said pressure transducer over said angle of rotational movement of about forty degrees;

said digital signal processor generating a digital pulse signal for each of said nine solenoids whenever said average pressure calculated for said solenoid over said angle of rotational movement of said shaft exceeds a predetermined threshold pressure level; and a solenoid driver having an input connected to the output of said digital signal processor for receiving said digital pulse signal;

said solenoid driver being connected to the input of each of said nine solenoids;

said solenoid driver, responsive to each digital pulse signal for each of said solenoids, actuating said solenoid for one revolution of said shaft at a corresponding solenoid decision point for said solenoids;

the rod of said solenoid being actuated extending to engage said check ball valve within the corresponding one of said nine inlet passageways allowing said fluid to be discharged through the corresponding one of said nine inlet passageways maintaining the pressure of said fluid at the outlet port of said housing at about said predetermined threshold pressure level.

13. The multi-piston pump of claim 12 predetermined threshold pressure level is selected from a range of about 500 psi to about 1500 psi.

14. The multi-piston pump of claim 12 wherein said fluid comprises seawater.

* * * * *